United States Patent [19]

Hell et al.

[11] Patent Number: 4,615,190

[45] Date of Patent: Oct. 7, 1986

[54] WET LAUNDRY DEWATERING APPARATUS

[75] Inventors: Günter Hell, Herford; Gerhard Bökamp, Löhne, both of Fed. Rep. of Germany

[73] Assignee: Herbert Kannegiesser GmbH & Co., Vlotho, Fed. Rep. of Germany

[21] Appl. No.: 665,243

[22] Filed: Oct. 26, 1984

[30] Foreign Application Priority Data

Nov. 12, 1983 [DE] Fed. Rep. of Germany ..... 3341058
Apr. 26, 1984 [DE] Fed. Rep. of Germany ..... 3415537

[51] Int. Cl.[4] ..... D06F 29/02
[52] U.S. Cl. ..... 68/241; 100/49; 100/125
[58] Field of Search ..... 68/241; 100/48, 49, 100/99, 53, 43, 116, 125

[56] References Cited

U.S. PATENT DOCUMENTS

| | | | |
|---|---|---|---|
| 3,613,559 | 10/1971 | Buisson | 100/49 |
| 3,802,335 | 4/1974 | Longo | 100/53 X |
| 3,930,248 | 12/1975 | Keller | 100/99 X |
| 4,457,418 | 7/1984 | Johnston | 100/53 X |

*Primary Examiner*—Harvey C. Hornsby
*Assistant Examiner*—Frankie L. Stinson
*Attorney, Agent, or Firm*—Sughrue, Mion, Zinn, Macpeak and Seas

[57] ABSTRACT

An appliance for dewatering wet laundry articles includes a vessel (12) for receiving the laundry articles to be dewatered and a pressure plunger (26) which is located above the vessel and which can be pressed onto the top edge of the latter or can be moved into it. A device for monitoring the top vessel edge (13) to check for laundry articles (10-1) possibly left lying on the edge when the laundry articles are introduced is designed in such a way that complete monitoring of the vessel edge (13) is provided.

23 Claims, 8 Drawing Figures

79
81
82
80
S2
S1
54
53
D1
87
56
R9
R7
C3
88 (50,51,55)
85
R6
86
46
52
R5
48
84
83
R8
ZD2
R4
C1
C2
ZD1
G1
G2
ZD3
W2
R3
W3
W1
U
R2
64
65
62
63
75
R1
76
77
78
110V~
47

WET LAUNDRY DEWATERING APPARATUS

BACKGROUND OF THE INVENTION

The invention relates to an appliance for dewatering washed laundry articles.

In known appliances, the edge-monitoring devices, which cannot be authenticated in publications, usually consist of four photoelectric tracer devices. These tracer devices are arranged in such a way that their light barriers extend directly above the vessel edge, each crossing the latter in the manner of a secant. The result of this secant principle is that it is not possible to monitor the vessel edge completely to check for laundry articles left lying on this edge when the laundry articles are introduced. This is a disadvantage because, as a result, it happens time and again that laundry articles left lying are caught and torn up by the pressure plunger coming down onto the vessel edge or moving into the vessel. However, a further disadvantage is that the photoelectric tracer devices can be fitted and adjusted according to requirements only with considerable difficulty, and also switching errors occur when these are subjected to cloudy water.

SUMMARY OF THE INVENTION

The object on which the invention is based is, therefore, to design the edge-monitoring device of the appliance so that complete monitoring of the vessel edge is provided.

The design, according to the invention, of the edge-monitoring device provides for complete monitoring of the vessel edge completely in the check for laundry articles left lying on it when the laundry articles are introduced (flushed in). Consequently, laundry articles can no longer be torn up.

Advantageous designs and developments of the edge-monitoring device according to the invention include particularly economical designs of the conductivity-measuring device, and an operationally reliable design of the conductivity evaluation unit of the latter.

The developments/designs have an advantageous effect on the operational reliability of the edge-monitoring device and therefore of the appliance as a whole. The operational reliability is increased even further by means whereby laundry articles not flushed properly into the vessel and/or (rinsing-water) foam bridges located in the insulation air gap are automatically transported (blown) into the vessel. The sensitivity of the conductivity-measuring device can be varied, and consequently, again, the operational reliability of the appliance increased, since "false alarms" can be prevented.

The edge-monitoring device according to the invention can be used both bn appliances with a pressure plunger which can be pressed onto the top vessel edge (German Patent Specification No. 2,852,923) and on those with a pressure plunger which can penetrate into the vessel (German Offenlegungsschrift No. 2,602,845), and furthermore on aopliances where the pressure plunger is moved into the vessel as a result of an appropriate stress exerted on its press cylinder (German Offenlegungsschrift No. 2,602,845) and even on those where the press cylinder and pressure plunger are arranged on a vertically movable pressure yoke and the pressure plunger is first introduced into the vessel as a result of an appropriate movement of this pressure yoke, and then, as a result of an appropriate stress exerted on the press cylinder, is moved further in the vessel or is pressed onto the laundry located in the latter (German Offenlegungsschrift No. 3,228,512). Thus, in the first case (German Offenlegungsschrift No. 2,602,845, the pressure plunger is introduced as a result of stress exerted on the press cylinder), the operative connection between the conductivity-measuring device and the pressure-plunger drive must be made to the hydraulic control valve of the press cylinder, and in the second case (German Offenlegungsschrift No. 3,228,512, the pressure plunger and press cylinder are arranged on a pressure yoke), it must be made to the hydraulic control valves of the pressure-yoke movement cylinders.

BRIEF DESCRIPTION OF THE DRAWINGS

The invention is explained below by means of exemplary embodiments with reference to the drawing in which.

DETAILED DESCRIPTION OF THE PREFERRED EMBODIMENTS

Figure 1:
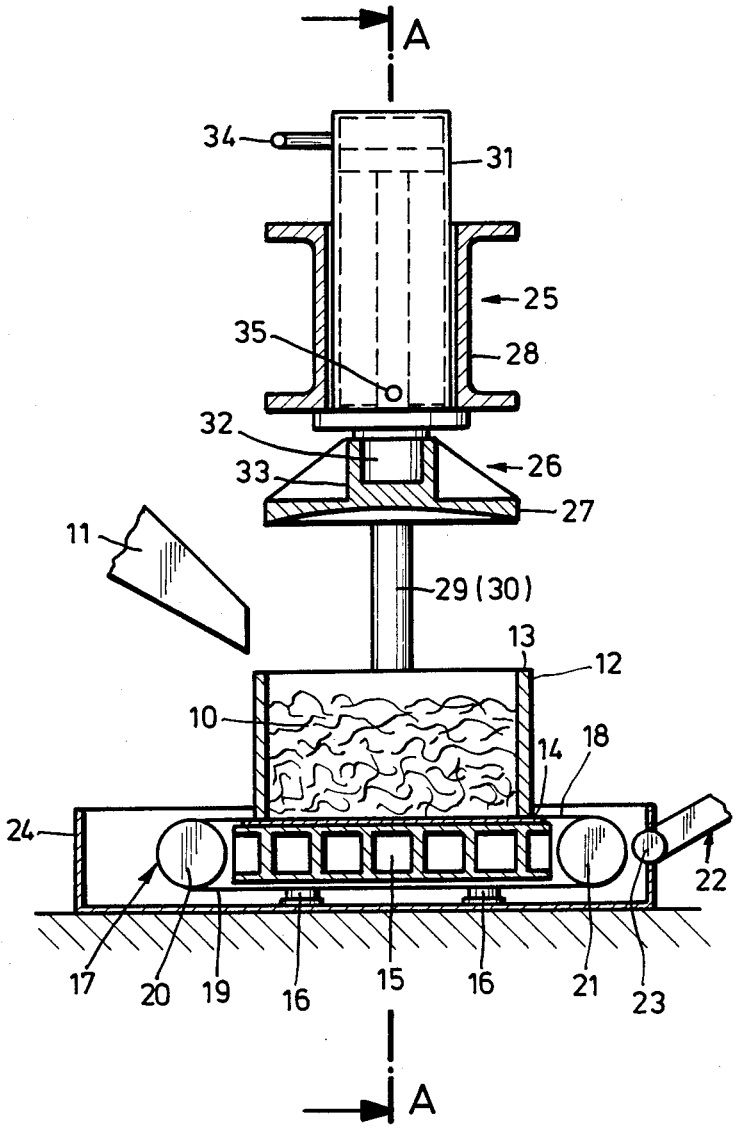
FIG. 1 shows a diagrammatic longitudinal section through the appliance, but without the edge-monitoring device.

The appliance illustrated in the drawings is intended for dewatering washed laundry articles 10 after they have been rinsed. A batch of these wet laundry articles is conveyed into the vessel 12 of the appliance, usually by means of rinsing water, via a chute 11 shown diagrammatically and coming from the washing or rinsing machine. After the batch of laundry has been introduced, the chute is moved to the side by means which are not shown.

Figure 7:
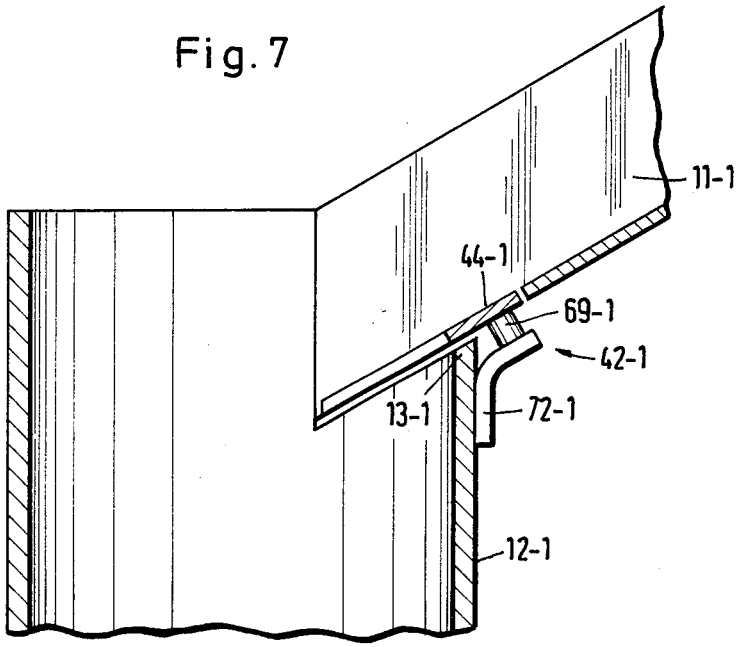
FIG. 7 shows a section through the edge-monitoring device according to a further exemplary embodiment of the invention.
Figure 8:
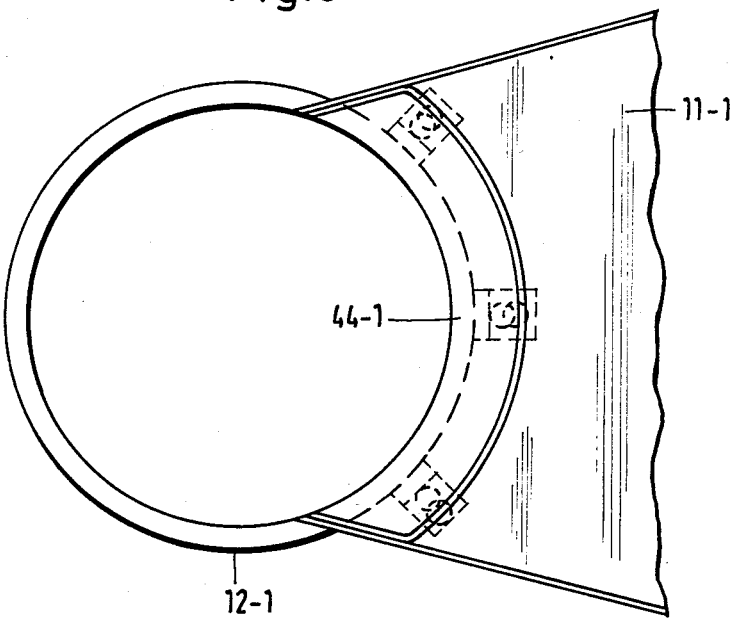
FIG. 8 shows a plan view of the edge-monitoring device of FIG. 7.

A more particular exemplary embodiment of the edge-monitoring device, in interaction with the chute, is described in more detail in relation to FIGS. 7 and 8

The vessel 12 has a cylindrical vessel shell and is closed at the bottom by a base structure. This consists of a counterpressure plate 14 which rests on a stable double-walled and ribbed base plate 15. The base plate 15 has supporting feet 16 and stands, together with these, in a water-collecting vessel 24 standing on the floor.

The counterpressure plate 14 is designed so that the water flowing out of the laundry articles 10 can escape from the vessel 12 in this region, that is to say at the bottom. For this purpose, the counterpressure plate 14 is designed with channels (not shown) which extend transversely to the conveying direction of the conveyor belt 17 described below and which take the form of grooves open upwards. In these, the water running off is received and conveyed away laterally.

The upper side 18 of the conveyor belt 17 lies on the top side of the counterpressure plate 14 designed in this way. After the dewatering operation has been completed, the laundry articles 10 can be transported away by this conveyor belt, in particular up to a discharge-conveyor belt 22, the drive and deflecting roller 23 of which is arranged adjacent to the drive and deflecting roller 21 of the conveyor belt 17. A second deflecting roller 20 of this conveyor belt is located on the opposite side of the base plate 15. The lower side 19 of the conveyor belt 17 extends on the underside of the base plate 15 between the supporting feet 16.

A pressure device 25 is arranged above the vessel 12. This consists essentially of the press cylinder 31 which can be stressed at both ends, with the hydraulic connections 34, 35 and the pressure plunger 26 arranged on its piston rod 32. The piston rod 32 of the press cylinder 31 is introduced by means of its lower end into the hub 33 of the pressure plunger 26 and is connected firmly to this hub. The pressure plunger 26 has on its underside a plunger plate 27. The latter is pressed by the press cylinder 31 under pressure onto the laundry articles 10 lying in the vessel 12. For this purpose, the press cylinder 31 is arranged on a pressure yoke 28 which is mounted in turn on lateral supporting columns 29, 30 standing on the base plate 15. The pressure plunger 26 and the plunger plate 27 are designed on the outside so that they can be introduced into the vessel 12 with a closing effect and retracted from it or so that they rest against the cylindrical vessel shell of the latter. The lower position (press position) of the pressure plunger 26 or of the plunger plate 27 is represented by dot-and-dash lines in FIG. 2.

Figure 2:
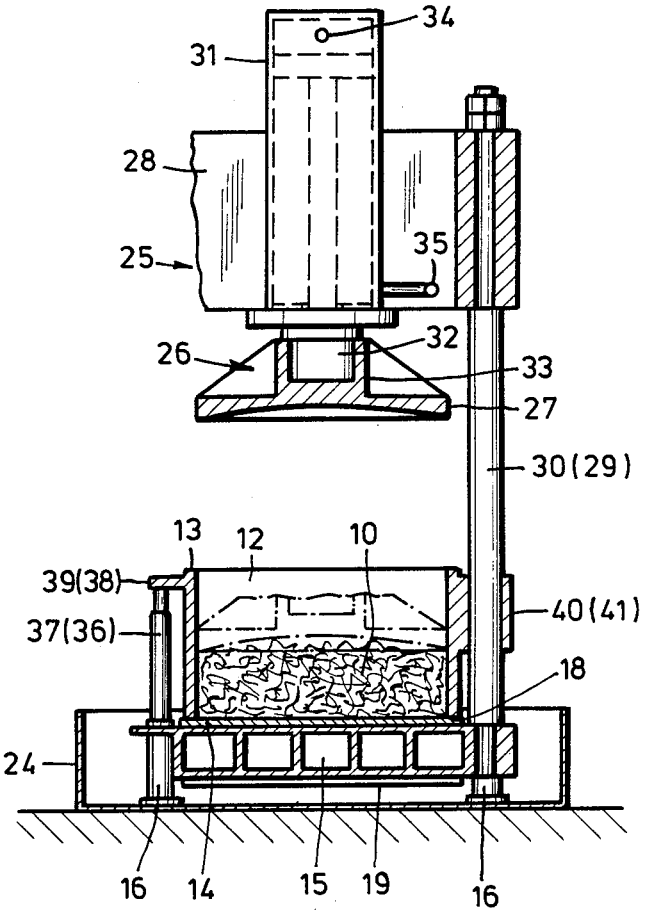
FIG. 2 shows a section along the sectional line A—A in FIG. 1.

The vessel 12 can be lifted off from the counterpressure plate 14 in order to transport the dewatering laundry articles 10 away. For this purpose, there are two lifting cylinders 36, 37 which on the one hand are supported on the base plate 15 and on the other hand are fastened to two extensions 38, 39 of the vessel 12. Furthermore, two plain bearings 40, 41 are arranged on the vessel 12 for the purpose of guiding the latter on the supporting columns 29, 30 when it is lifted off (FIG. 2). As a result of appropriate stress exerted on the lifting cylinders 36, 37, the vessel 12 is lifted off from the counterpressure plate 14 until the pressed or dewatering batch of laundry rests on the conveyor belt 17, without being retained laterally, and, when this is driven in the direction of the discharge-conveyor belt 22, is conveyed onto the latter. After the batch of laundry has been conveyed away, the vessel 12 is moved into its lower basic position again as a result of an opposing stress exerted on the lifting cylinders 36, 37 and can then be filled again with laundry articles to be dewatered.

The twin supporting columns 29, 30, lifting cylinders 36, 37, extensions 38, 39 and plain bearings 40, 41 are each arranged either opposite one another or offset relative to one another according to requirements in a way which is known per se, but is not illustrated.

Figure 3:
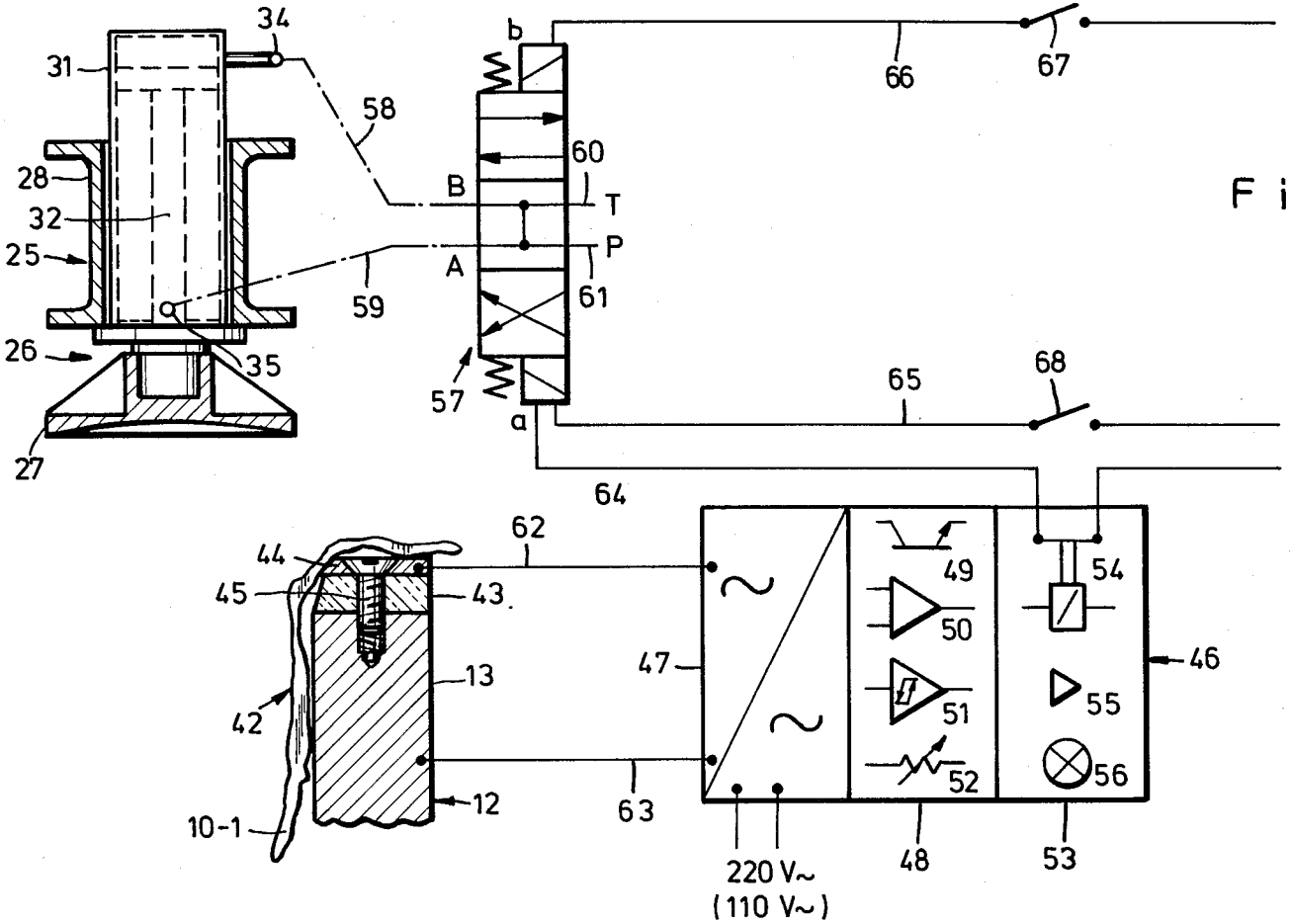
FIG. 3 shows the edge-monitoring device and its electrical connection to the pressure device or the pressure plunger, partially in a diagrammatic and greatly simplified representation not true to scale.

According to an exemplary embodiment of the invention, the edge-monitoring device illustrated in FIG. 3 consists first of the conductivity-measuring device 42 and the conductivity evaluation unit 46. These devices-/units 42, 46 are operatively connected both to one another and to the electrical control of the hydraulic control valve 57 located in the hydraulic-fluid inflow and flow-off (hydraulic lines 58 to 61) to and from the press cylinder 31. The operative connection is such that, when a current flow is detected by the conductivity-measuring device 42 (occurring when a wet laundry article 10-1 rests on the latter), it is not possible for the pressure plunger 26 to execute a descending movement from its upper basic position into the lower press position.

The conductivity-measuring device 42 is formed from the electrically conductive vessel edge 13, an insulating layer which rests on the end face of the latter and which is designed here as a non-conductive annular panel 43, and a conductive cover plate 44 which rests in turn on the latter. The non-conductive annular panel 43 is made of plastic and is at least 5.0 mm thick, to avoid a conductive connection between the upper cover plate 44 and the vessel edge 13 being made prematurely by water drops possibly caught on the annular panel. The cover plate 44 is an approximately 2 mm thick stainless steel (V2A) annular panel. The vessel edge 13, the annular panel 43 and the cover plate 44 are glued to one another and they are also screwed to one another by means of plastic screws 45. This ensures that no current can flow between the two measuring probes (the vessel edge 13 and cover plate 44) via the means of connection.

The conductivity evaluation unit 46 has an alternating measuring-voltage generator (transformer) 47, a signal shaper device 48 and a switching amplifier 53. The signal shaper device 48 in turn is formed essentially from a signal shaper 49, a comparator 50, a Schmitt trigger 51 with a fixed hysteresis and a potentiometer 52 for adjusting the sensitivity of response of the alternating measuring-voltage generator 47. The switching amplifier 53 is formed essentially from a relay 54 and an amplifier 55, and it also has a switch-state indicator 56.

The hydraulic control valve 57 located in the hydraulic-fluid inflow to and flow-off from the press cylinder 31, the conductivity evaluation unit 46 and the conductivity-measuring device 42 are connected to one another in control terms by means of the electrical lines 62, 63, 64 and to the central control device (not shown) of the appliance by means of the lines 65, 66 and the switching relays 67, 68.

The annular conductivity-measuring device 42 is designed for a (measuring-probe) voltage of 7.5 to 15.0 volt. The conductivity evaluation unit 46 has a 220 or 110 volt mains connection and an internal processing voltage of 24 volt which also prevails in the region of the control of the hydraulic control valve 57 designed as a solenoid valve.

It is advantageous for the operational reliability of the edge-monitoring device if it undergoes an operational test before each new dewatering operation and if this operational test or its positive outcome is made a precondition for the subsequent movement of the pressure plunger 26 from its upper basic position in the direction of the vessel 12. As regards this operational test, the following mode of operation takes place before the actual dewatering of the laundry articles:

The wet laundry articles coming from a washing or rinsing machine (not shown) are conveyed with their rinsing water into the vessel 12 via the chute 11. At the same time, when the chute 11 is arranged and designed in an appropriate way, some of the laundry articles and/or some of the rinsing water necessarily come in contact with the conductivity-measuring device 42, in such a way that there occurs between the two measuring probes of the latter (the vessel edge 13 and cover plate 44) a current flow which is then processed in the following conductivity evaluation unit 46. If processing is carried out perfectly in the conductivity evaluation unit 46, that is to say when the latter is fully operational, the first precondition for releasing the descending movement of the pressure plunger 26 as a result of appropriate stress exerted on the press cylinder 31 is satisfied. The result of the operational test is signalled in a way known per se to the central control device (not shown) and is stored in this for the duration of the pending dewatering operation. When the vessel filling operation is then completed, this being detected by means of appropriate monitoring of the latter (photocells or the like) the descending movement of the pressure plunger 26 is demanded as a result of sequential control, but this only takes place when the above-mentioned operational test has had a positive result and when, at the time of demand, there is no new current flow between the two measuring probes (the vessel edge 13 and cover plate 44) in the conductivity-measuring device 42, for example caused by a laundry article 10-1 caught completely or partially on the vessel edge during the filling operation (FIG. 3). Thus, a precondition for the release of the sequentially controlled descending movement of the pressure plunger 26 is a positive result in the operational test and a negative result in the check of the vessel edge carried out after the filling operation is completed.

The course of the actual dewatering operation emerges from the above description or is known.

Moreover, the appliance has all the further devices and parts known per se, but not illustrated, which are required to operate the appliance, such as, in particular, also an hydraulic unit for generating the hydraulic energy for moving the press cylinder 31 and the lifting cylinders 36, 37.

Figure 4:
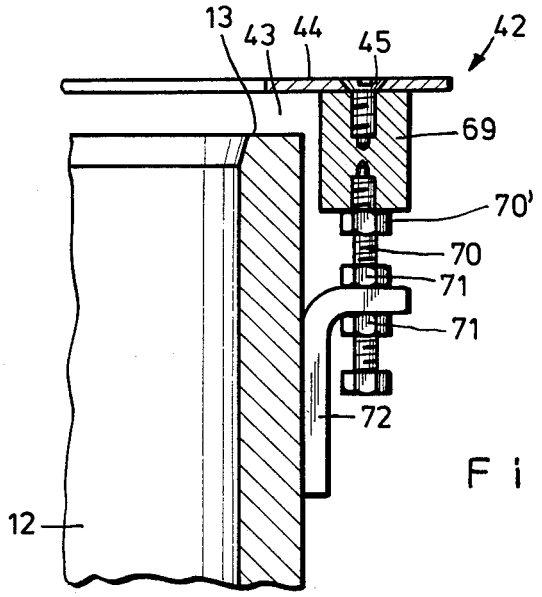
FIG. 4 shows a section through the edge-monitoring device according to a further exemplary embodiment of the invention.

In the exemplary embodiment of the conductivity-measuring device 42 according to FIG. 4, the insulation 43 between the vessel edge 13 located on the end face and the cover plate 44 is formed by an air gap. The cover plate 44 projects radially beyond the lateral edge of the vessel 12 and is fastened by means of a screw 45, if appropriate also by means of glueing in addition or alternatively, to a supporting body 69 consisting of electrically insulating material, for example plastic. The supporting body 69 can be designed as a closed ring, but several separate block-shaped supporting bodies can also be used. An adjusting screw 70 is screwed into the underside of the supporting body 69, and the axial position of the adjusting screw is fixed in relation to a retaining bracket 72 via lock nuts 71. The retaining bracket 72 is attached, for example welded, to the outer wall of the vessel 12 by means of one leg, whilst a leg projecting radially outwards from the vessel has bores for receiving the adjusting screws 70. The nuts 71 are located on both sides of the latter leg, so that the adjusting screw 70 is fixed axially in both directions of movement. Furthermore, the adjusting screw 70 can be secured against rotation relative to the supporting body 69 by means of a further lock nut 70'.

To prevent electrically conductive bridges from being formed by water, the supporting body 69 is enlarged in relation to the radially outer edge of the vessel 12, so that there is a certain air gap even in the radial direction.

The sensitivity of the conductivity-measuring device 42 can be adjusted as a result of an adjustment of the height of the air gap 43. Preferably, the size of the air gap is of the order of 4 to 10 mm, especially around 6 mm. This ensures, on the one hand, that no electrically conductive "bridge" to the cover plate 44 is formed by water drops possibly lying on the vessel edge 13 on the end face and, on the other hand, that a wet laundry article bridging the air gap 43 causes a sufficiently heavy electrical current to flow over this length, thus allowing this state to be identified with perfect reliability.

Figure 5:
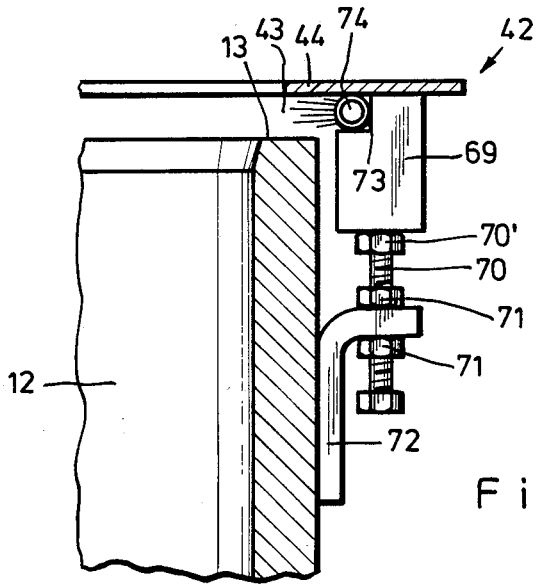
FIG. 5 shows a section similar to that of FIG. 4, but according to a further design of the invention.

A development of the exemplary embodiment of FIG. 4 is given in FIG. 5. In this development, the supporting body 69 possesses, in the region of its upper end pointing radially inwards towards the vessel 12, a recess 73 in which a blowing device 74 is accommodated. This blowing device 74 can be a nozzle tube, that is to say a tube which can be subjected to compressed air and which has air outflow nozzles directed radially inwards to the air gap 43. When it is detected, during a measuring operation, that an electrically conductive connection exists between the vessel edge 13 and the cover plate 44, this possibly being caused by laundry articles or, in the case of particularly critical washing liquors, also by foam bridges occurring when the laundry articles are flushed in, then the blowing device is activated, that is to say subjected to compressed air. Parts of laundry articles or foam bridges between the vessel edge 13 and the cover plate 44 are then blown away by the compressed air, specifically into the interior of the vessel 12.

The appliance control (not shown) according to FIG. 5 is designed so that the blowing device 74 is activated only during the actual measuring phase which occurs in terms of time between the flushing-in of the laundry articles and the start of descent of the pressure plunger.

Figure 6:
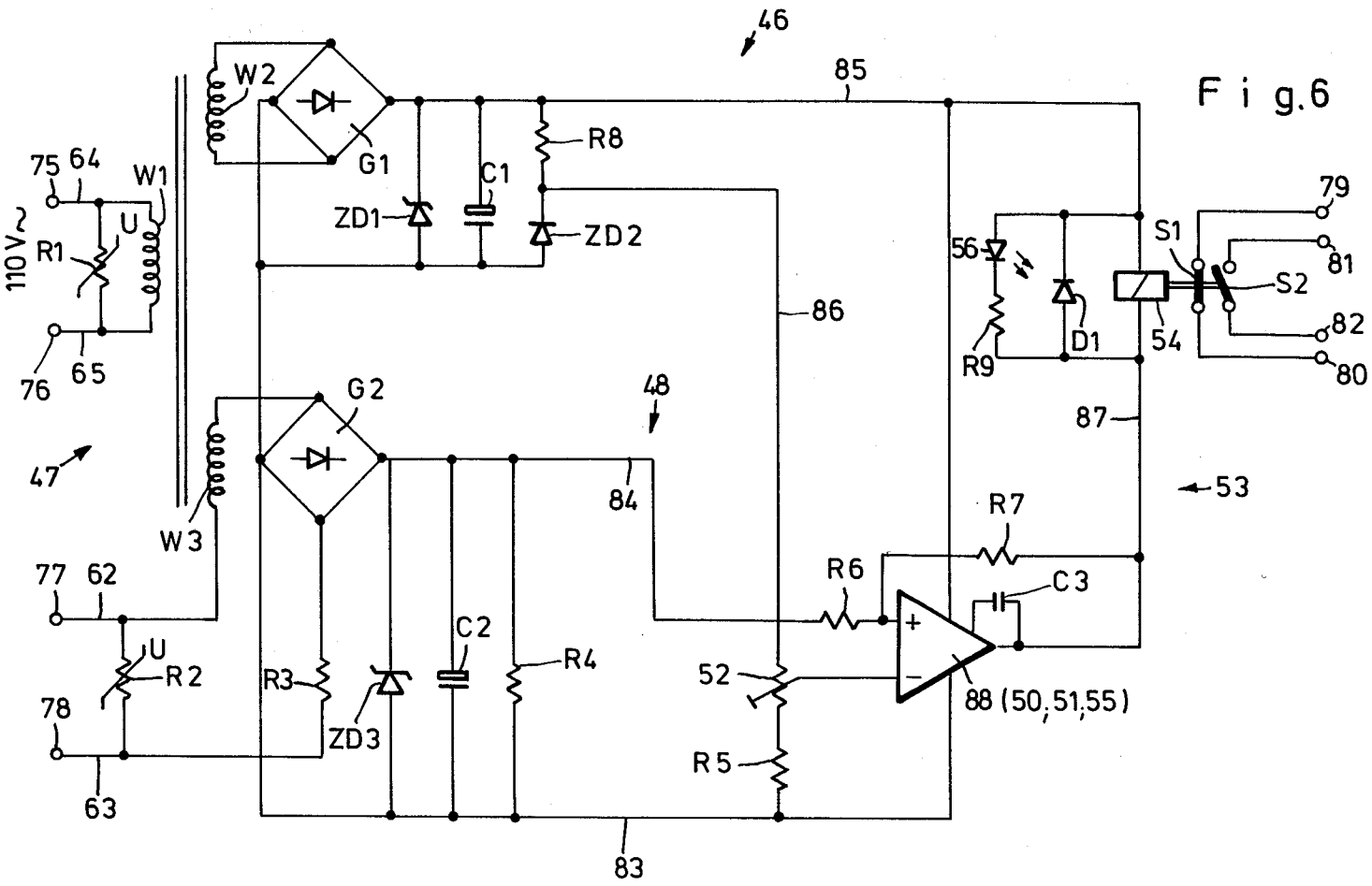
FIG. 6 shows a circuit diagram of the electrical conductivity evaluation unit of the edge-monitoring device.

FIG. 6 shows a detailed circuit diagram of the conductivity evaluation unit 46. The same reference symbols as in FIG. 3 denote functionally identical parts.

As an alternating measuring-voltage generator 47, there is here provided a transformer which has a primary winding W1 and two secondary windings W2 and W3. The primary winding is connected to the mains, for example 220 volt or 110 volt, by means of the lines 64, 65 and the terminals 75, 76 of the latter. A voltage-dependent resistor (varistor) R1 is in parallel with the primary winding W1.

The secondary winding W3 is connected to the line 62 which is connected via a terminal 77 to the conductivity-measuring device 42, that is to say to the cover plate 44 or the vessel edge 13. The other terminal of the secondary winding W3 is connected to one input of a rectifier bridge circuit G2. The other input of the rectifier bridge circuit G2 is connected via a resistor R3 to the line 63 which is connected, again via a terminal 78, to the conductivity-measuring device 42, that is to say to the vessel edge 13 or the cover plate 44. Thus, the actual "measuring zone" lies electrically between the terminals 77 and 78. A voltage-dependent resistor (varistor) R2 is in parallel with this measuring zone.

One output of the rectifier bridge circuit G2 is connected to an electrical line 83 carrying the reference potential. Because of the electrical isolation caused by the transformer 47, the potential of this line 83 is not necessarily grounded, and the advantage of this for safety reasons is that the conductivity-measuring device 42 or its cover plate 44 and its vessel edge 13 are potential-free. The other output of the rectifier bridge circuit G2 is connected to a line 84. Between the lines 83 and 84, a Zener diode ZD3, a capacitor C2 and a resistor R4 are in parallel with one another. The Zener diode ZD3 serves for voltage limitation, and the capacitor C2 serves for smoothing the rectified voltage. The resistor R4 is the actual measuring resistor here, since the voltage dropping at it is proportional to the current over the measuring zone (terminals 77, 78). (The threshold voltage of the particular two active diodes of the rectifier bridge circuit G2 may be ignored here.)

Furthermore, the line 84 is connected via a resistor R6 to a terminal of an operational amplifier 88 which here performs the functions of the comparator 50, the Schmitt trigger 51, the switching amplifier 53 and the amplifier 55 of FIG. 3. The operational amplifier 88 is fed back via a resistor R7, the edge steepness of the output signal also being improved via a Miller capacitor C3.

An adjustable reference voltage is fed by the potentiometer 52 to the other input (reference input) of the operational amplifier 88. Thus, the comparator 50 of the operational amplifier 88 compares the voltage at the resistor R4 with the reference voltage of the potentiometer 52. The reference voltage and also the operating voltage for individual components of FIG. 6 are generated by a "power pack" which is composed as follows: the voltage at the secondary winding W2 is rectified in a known way via a rectifier bridge circuit G1, limited by a Zener diode ZD1 and smoothed by a capacitor C1. One output of the rectifier bridge circuit G1 is connected to the line 83, whilst the other output is connected to a line 85. Thus, the "operating voltage" is between the lines 83 and 85. The reference voltage for the comparator 50 is tapped from a series connection consisting of a resistor R8 and a Zener diode ZD2, this series connection being located between the lines 83 and 85. A series connection consisting of the potentiometer 52 and a resistor R5 is electrically in parallel (line 86) with the Zener diode ZD2. The tap of the potentiometer 52 then carries the adjustable reference voltage for the comparator 50. The output of the operational amplifier 88 is connected to one terminal of the relay 54, the other terminal of this relay 54 being connected to the line 85.

Anti-parallel with the relay 54 is a free-running diode D1 which prevents voltage peaks during switching operations. Furthermore, a series connection consisting of a resistor R9 and a switch-state indicator 56, which is a luminous diode here, is in parallel with the relay 54.

Here, the relay 54 actuates two switch contacts S1 and S2 which respectively connect terminals 79, 80 and 81, 82 to one another. In a state of rest, the switch contacts S1 are connected to one another whilst the switch contacts S2 are open.

The circuit of FIG. 6 works as follows: when a voltage is induced in the secondary winding W3, an electrical current flows along the following path: the secondary winding W3, a branch of the rectifier bridge circuit G2, a portion of the line 84, the resistor R4, a portion of the line 83, a second branch of the rectifier bridge circuit G2, the resistor R3, if appropriate the measuring zone between the terminals 78, 77 and from there back to the secondary winding W3. If the internal resistance or ohmic resistance of the secondary winding W3 and of the particular two diodes active of the rectifier bridge circuit is ignored, the magnitude of the flowing electrical current is determined by the ohmic resistance of the measuring zone and the resistors R3 and R4 which are in series with the latter. The resistor R3 could, in principle, also be omitted, but it limits possible short-circuit currents in the short-circuiting of the measuring zone. The above current path occurs, with the sign being correct, when negative potential lies at the terminal of the secondary winding W3, connected to the terminal 77, in relation to the other terminal of the secondary winding W3. When the polarity is reverse, the current flow is correspondingly reverse, that is to say: the secondary winding W3, the measuring zone, the resistor R3, a bridge branch, a portion of the line 84, the resistor R4, a portion of the line 83, a second bridge branch and the secondary winding W3. In contrast to this, the direction of the current flow through the resistor R4 is constant with both polarities, that is to say the line 84 always carries a positive potential in relation to the line 83. The amount of this potential depends on the magnitude of the current through the resistor R4 and consequently on the magnitude of the current across the measuring zone 77, 78. (The internal resistance of the operational amplifier 88 can be assumed to be infinite.)

The comparative value at the potentiometer 52 is now adjusted so that the operational amplifier 88 does not switch through when there is no current flowing across the measuring zone 77–78. In contrast, when a current of predetermined magnitude flows across the measuring zone 77–78, the operational amplifier 88 switches through, whereupon the relay 54 is reversed. The desired functions can then be controlled via the switch contacts S1 and S2, that is to say the hydraulic control valve 57 and consequently the movement of the pressure plunger 26. Likewise, the blowing device 74 can be switched effectively thereby.

Depending on the switching state of the relay 54, the switch-state indicator 56 is activated or the luminous diode shown in the exemplary embodiment of FIG. 6 lights up.

FIGS. 7 and 8 illustrate a further exemplary embodiment of the arrangement of the edge-monitoring device. The vessel 12-1 has a cut-out in the region of its top edge, so that a segment of the vessel edge 13-1 is lower than the remaining vessel edge. The chute 11-1, which can be connected to the vessel so as to slope from the top downwards, opens into this segment. In the region of the outflow orifice of the chute 11-1 there is, in a similar way to the exemplary embodiments described above, a cover plate 44-1 which consequently only extends along the segment here. This cover plate 44-1 is also at a distance from the vessel edge 13-1 and is isolated electrically from the vessel, this being effected by the supporting body 69-1 and retaining bracket (72-1) which are shown diagrammatically. The cover plate 44-1 is inclined relative to the longitudinal axis of the vessel, specifically at the same angle as the chute 11-1, so that the cover plate 44-1 and the chute 11-1 lie in one plane. The outward-pointing edge of the cover plate 44-1 extends parallel to the edge of the chute 11-1 pointing forwards, that is to say towards the vessel. Between these two edges there is a small air gap, by means of which the cover plate 44-1 is isolated electrically from the chute 11-1.

Of course, in this exemplary embodiment, the cover plate 44-1 can be adjusted in terms of its height in a similar way to the exemplary embodiment of FIG. 4. It is also possible to arrange, in the region between the cover plate 44-1 and the supporting body 69-1, a blowing device similar to the nozzle tube 74 of the exemplary embodiment of FIG. 5.

With the exception of the configuration of the cover plate 44-1 covering only a segment of the vessel edge and, if appropriate, with the exception of the lower positioning of the cover plate 44-1 relative to the remaining vessel edge, the exemplary embodiment of FIGS. 7 and 8 corresponds to the exemplary embodiments described above. Thus, in particular, the electrical or electronic part of the conductivity-measuring device of the exemplary embodiments described above can also be used here.

We claim:

1. An appliance for dewatering washed laundry articles, comprising: a cylindrical vessel (12) for receiving the laundry articles to be dewatered, a lower counter-pressure plate (27) permeable to water, a pressure plunger (26) which is located at a distance above the vessel and which can be pressed onto a top edge (13) of the vessel or moved into it, a device for monitoring the top edge of the vessel to check for laundry articles left lying on said edge when the laundry articles are introduced into the vessel, and an electrical control device operatively connected to the edge-monitoring device for controlling a hydraulic drive of the pressure plunger, wherein the edge-monitoring device comprises an electrical conductivity-measuring device (42) disposed at the top vessel edge (13) and extending in a same direction thereas, and a conductivity evaluation unit (46), and wherein said conductivity-measuring device and said evaluation unit (42, 46) are operatively connected to one another and to an electrical control line of a hydraulic control valve (57) located in a hydraulic fluid inflow to and flow-off from a pressure cylinder (31) of the pressure plunger (26) such that when a current flow is detected by the conductivity-measuring device (42) in response to the presence of a wet laundry article it is not possible for the pressure plunger (26) to execute a descending movement.

2. An appliance as claimed in claim 1, wherein the conductivity-measuring device (42) comprises a conductive vessel edge (13), an insulation (43) arranged above said edge, and a conductive cover plate (44) arranged in turn above the insulation.

3. An appliance as claimed in claim 2, wherein the cover plate (44-1) extends only along a segment of the vessel edge (13-1), said segment corresponding to an outflow orifice of a chute (11-1) for delivering the laundry.

4. An appliance as claimed in claim 3, wherein the vessel edge (13-1) located opposite the cover plate (44-1) is disposed lower in the region of the outflow orifice of the chute (11-1) than the remaining vessel edge.

5. An appliance as claimed in claims 2, 3 or 4, wherein the insulation is designed as a non-conductive annular plastic panel (43), preferably at least 5.0 mm thick.

6. An appliance as claimed in claim 5, wherein the vessel edge (13), the annular panel (43) and the cover plate (44) are glued to one another.

7. An appliance as claimed in claim 5, wherein the vessel edge (13), the annular panel (43) and the cover plate (44) are screwed to one another by means of plastic screws (45).

8. An appliance as claimed in claims 2, 3 or 4, wherein the insulation is an air gap (43), preferably, on the order of 4 to 10 mm, especially 6 mm.

9. An appliance as claimed in claims 2, 3 or 4, wherein an approximately 2 to 4 mm thick stainless steel annular plate serves as the conductive cover plate (44).

10. An appliance as claimed in claim 2, wherein the vessel edge (13) and the cover plate (44) of the conductivity-measuring device (42) are each connected to a pole of an electrical voltage source (W3, G2, R3), and wherein the conductivity evaluation unit (46) checks whether an electrical current flows or does not flow between the vessel edge (13) and the cover plate (44).

11. An appliance as claimed in claim 10, wherein the voltage source contains a series connection consisting of a transformer winding (W3), a rectifier (62), a protective resistor (R3) and a measuring resistor (R4), and wherein the voltage drop at the measuring resistor (R4) is compared with a predetermined threshold value in a comparator (50) for monitoring an electrical current between the vessel edge (13) and the cover plate (44).

12. An appliance as claimed in claim 11, wherein the output of the comparator (50) controls by means of a Schmitt trigger (51) and an amplifier (55) a switching relay (54) which controls the movement of the pressure plunger (26) or which switches a hydraulic control valve (57).

13. An appliance as claimed in claim 11, wherein the predetermined threshold value is adjustable by means of a potentiometer (52).

14. An appliance as claimed in claim 13, wherein the potentiometer (52) is connected to a constant-voltage source (W2, G1, ZD1, C1, ZD2, R8).

15. An applliance as claimed in claim 11, wherein the comparator (50) has a preset hysteresis.

16. An appliance as claimed in claim 10, wherein the conductivity evaluation unit (46) has a switch-state indicator (56).

17. An appliance as claimed in claim 2, further comprising, between the vessel edge (13) and the cover plate (44), a blowing device (74) for directing compressed air radially inwards towards the vessel (12) when the conductivity-measuring device (42) detects a current flow.

18. An appliance as claimed in claim 17, wherein the blowing device (74) can be activated, between each delivery of laundry articles into the vessel (12) and a subsequent movement of the pressure plunger (26) from an upper position thereof.

19. An appliance as claimed in claim 2 wherein the cover plate (44) is adjustable in an axial direction of the vessel (12).

20. An appliance as claimed in claims 1 or 2, wherein the conductivity-measuring device (42) is designed for a measuring-probe voltage of 7.5 to 15 volts.

21. An appliance as claimed in claim 20, wherein the conductivity evaluation unit (46) is designed for an internal processing voltage of 24 volts.

22. An appliance as claimed in claim 1, wherein, during the delivery of the laundry articles into the vessel (12), the edge-monitoring device undergoes an operational test by means of an appropriate evaluation of the current flow, occurring at least once during said, in the annular conductivity-measuring device (42).

23. An appliance as claimed in claim 22, wherein the operational test is conducted during each new delivery of laundry articles into the vessle (12), and wherein the operational test is a precondition for subsequent movement of the pressure plunger (26) from an upper position in the direction of the vessel (12).

* * * * *